US007497767B2

(12) United States Patent
Chen et al.

(10) Patent No.: US 7,497,767 B2
(45) Date of Patent: Mar. 3, 2009

(54) VIBRATION DAMPING DURING CHEMICAL MECHANICAL POLISHING

(75) Inventors: Hung Chih Chen, Santa Clara, CA (US); Shijian Li, San Jose, CA (US); John M. White, Hayward, CA (US); Ramin Emami, San Jose, CA (US); Fred C. Redeker, Fremont, CA (US); Steven M. Zuniga, Soquel, CA (US); Ramakrishna Cheboli, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 151 days.

(21) Appl. No.: 11/046,189

(22) Filed: Jan. 28, 2005

(65) Prior Publication Data

US 2005/0245181 A1 Nov. 3, 2005

Related U.S. Application Data

(60) Continuation-in-part of application No. 10/124,066, filed on Apr. 16, 2002, now Pat. No. 6,848,980, which is a continuation-in-part of application No. 09/975,196, filed on Oct. 10, 2001, application No. 11/046,189, which is a continuation-in-part of application No. 10/754,997, filed on Jan. 10, 2004, now Pat. No. 7,014,545, which is a division of application No. 09/658,417, filed on Sep. 8, 2000, now Pat. No. 6,676,497, application No. 11/046,189, which is a continuation-in-part of application No. 09/975,196, filed on Oct. 10, 2001, which is a continuation-in-part of application No. 09/658,417, filed on Sep. 8, 2000, now Pat. No. 6,676,497.

(51) Int. Cl.
*B24B 5/35* (2006.01)

(52) U.S. Cl. ..... 451/398; 451/288; 451/290

(58) Field of Classification Search ..... 384/193, 384/194, 206, 228; 451/41, 285, 286, 287, 451/288, 289, 290, 385, 398
See application file for complete search history.

(56) References Cited

U.S. PATENT DOCUMENTS 3,504,457 A 4/1970 Jacobsen (Continued)

FOREIGN PATENT DOCUMENTS

EP 0 156 746 A1 10/1985

(Continued)

OTHER PUBLICATIONS

B. Holley and E. Mendel, "Mounting Method for Single-Side Polishing", Mar. 1979, IBM Technical Disclsosure Bulletin, vol. 21, No. 10.

(Continued)

*Primary Examiner*—Timothy V Eley
(74) *Attorney, Agent, or Firm*—Fish & Richardson

(57) ABSTRACT

A carrier head for chemical mechanical polishing is described. The carrier head includes a backing assembly, a housing and a damping material. The backing assembly includes a substrate support surface. The housing is connectable to a drive shaft to rotate with the drive shaft about a rotation axis. In one implementation, the damping material is in a load path between the backing assembly and the housing to reduce transmission of vibrations from the backing assembly to the housing.

3 Claims, 6 Drawing Sheets

U.S. PATENT DOCUMENTS

| | | | | | |
|---|---|---|---|---|---|
| 3,747,282 | A | | 7/1973 | Katzke | |
| 3,833,230 | A | * | 9/1974 | Noll | 279/3 |
| 4,141,180 | A | | 2/1979 | Gill et al. | |
| 4,193,226 | A | | 3/1980 | Gill et al. | |
| 4,194,324 | A | * | 3/1980 | Bonora et al. | 451/289 |
| 4,217,766 | A | | 8/1980 | Suckow | |
| 4,373,991 | A | | 2/1983 | Banks | |
| 4,519,168 | A | | 5/1985 | Cesna | |
| 4,897,966 | A | * | 2/1990 | Takahashi | 451/287 |
| 4,905,772 | A | | 3/1990 | Honsa et al. | |
| 4,954,142 | A | | 9/1990 | Carr et al. | |
| 5,004,764 | A | | 4/1991 | Yamamoto et al. | |
| 5,061,778 | A | | 10/1991 | Uchida et al. | |
| 5,081,795 | A | | 1/1992 | Tanaka et al. | |
| 5,095,661 | A | * | 3/1992 | Gill et al. | 451/111 |
| 5,133,316 | A | | 7/1992 | Kasai et al. | |
| 5,205,082 | A | | 4/1993 | Shendon et al. | |
| 5,230,184 | A | | 7/1993 | Bukham | |
| 5,262,232 | A | | 11/1993 | Wilfong et al. | |
| 5,276,545 | A | * | 1/1994 | Daun et al. | 359/198 |
| 5,423,558 | A | | 6/1995 | Koeth et al. | |
| 5,423,716 | A | | 6/1995 | Strasbaugh | |
| 5,441,444 | A | | 8/1995 | Nakajima | |
| 5,443,416 | A | | 8/1995 | Volodarsky | |
| 5,449,316 | A | | 9/1995 | Strasbaugh | |
| 5,584,746 | A | | 12/1996 | Tanaka et al. | |
| 5,584,751 | A | | 12/1996 | Kobayashi et al. | |
| 5,605,488 | A | | 2/1997 | Ohashi et al. | |
| 5,624,299 | A | | 4/1997 | Shendon | |
| 5,635,083 | A | | 6/1997 | Breivogel et al. | |
| 5,643,061 | A | | 7/1997 | Jackson et al. | |
| 5,645,474 | A | | 7/1997 | Kubo et al. | |
| 5,664,988 | A | | 9/1997 | Stroupe et al. | |
| 5,679,064 | A | | 10/1997 | Nishi et al. | |
| 5,695,392 | A | | 12/1997 | Kim | |
| 5,716,264 | A | | 2/1998 | Kimura et al. | |
| 5,717,267 | A | | 2/1998 | Paroz | |
| 5,733,182 | A | | 3/1998 | Muramatsu et al. | |
| 5,738,568 | A | | 4/1998 | Jurjevic et al. | |
| 5,740,893 | A | | 4/1998 | Yamamoto | |
| 5,759,918 | A | | 6/1998 | Hoshizaki et al. | |
| 5,795,215 | A | | 8/1998 | Guthrie et al. | |
| 5,820,448 | A | | 10/1998 | Shamouilian et al. | |
| 5,851,140 | A | | 12/1998 | Barns et al. | |
| 5,876,273 | A | * | 3/1999 | Yano et al. | 451/288 |
| 5,899,798 | A | | 5/1999 | Trojan et al. | |
| 5,908,530 | A | | 6/1999 | Hoshizaki et al. | |
| 5,916,015 | A | | 6/1999 | Natalicio | |
| 5,916,412 | A | | 6/1999 | Nakashiba et al. | |
| 5,916,954 | A | | 6/1999 | Bohn et al. | |
| 5,944,590 | A | | 8/1999 | Isobe et al. | |
| 5,993,302 | A | | 11/1999 | Chen et al. | |
| 6,007,252 | A | | 12/1999 | Thelen et al. | |
| 6,019,670 | A | | 2/2000 | Cheng et al. | |
| 6,036,587 | A | | 3/2000 | Tolles et al. | |
| 6,044,818 | A | | 4/2000 | Decuir | |
| 6,068,394 | A | | 5/2000 | Dublin, Jr. | |
| 6,068,548 | A | | 5/2000 | Vote et al. | |
| 6,077,385 | A | | 6/2000 | Kimura et al. | |
| 6,102,777 | A | | 8/2000 | Duescher et al. | |
| 6,106,379 | A | * | 8/2000 | Mosca | 451/288 |
| 6,113,479 | A | | 9/2000 | Sinclair et al. | |
| 6,116,990 | A | * | 9/2000 | Sinclair et al. | 451/259 |
| 6,121,142 | A | | 9/2000 | Crevasse et al. | |
| 6,183,354 | B1 | | 2/2001 | Zuniga et al. | |
| 6,190,238 | B1 | | 2/2001 | Tanaka et al. | |
| 6,196,904 | B1 | | 3/2001 | Matsuo et al. | |
| 6,227,955 | B1 | | 5/2001 | Custer et al. | |
| 6,251,215 | B1 | | 6/2001 | Zuniga et al. | |
| 6,261,958 | B1 | | 7/2001 | Crevasse et al. | |
| 6,273,803 | B1 | | 8/2001 | Wang et al. | |
| 6,277,008 | B1 | | 8/2001 | Masuta et al. | |
| 6,306,021 | B1 | | 10/2001 | Masumura et al. | |
| 6,386,947 | B2 | * | 5/2002 | Donohue | 451/8 |
| 6,390,904 | B1 | | 5/2002 | Gleason et al. | |
| 6,425,812 | B1 | * | 7/2002 | Pant et al. | 451/307 |
| 6,447,368 | B1 | | 9/2002 | Fruitman et al. | |
| 6,494,774 | B1 | | 12/2002 | Zuniga et al. | |
| 6,627,098 | B2 | | 9/2003 | Custer et al. | |
| 6,666,756 | B1 | | 12/2003 | Travis | |
| 6,755,723 | B1 | * | 6/2004 | Pham | 451/41 |
| 2001/0031612 | A1 | | 10/2001 | Scott et al. | |
| 2002/0004357 | A1 | | 1/2002 | Baker et al. | |
| 2002/0081946 | A1 | | 6/2002 | Scott et al. | |
| 2002/0167757 | A1 | | 11/2002 | McCutcheon et al. | |
| 2004/0013819 | A1 | | 1/2004 | Hou et al. | |
| 2005/0020082 | A1 | | 1/2005 | Vishwanathan et al. | |
| 2006/0118525 | A1 | | 6/2006 | Ward | |

FOREIGN PATENT DOCUMENTS

| | | | |
|---|---|---|---|
| EP | 0 747 167 | A2 | 12/1996 |
| EP | 0 776 730 | | 6/1997 |
| EP | 0 790 100 | A1 | 8/1997 |
| EP | 0 841 123 | A1 | 5/1998 |
| EP | 0 988 931 | | 3/2000 |
| GB | 2 307 342 | A | 5/1997 |
| GB | 2 336 121 | | 10/1999 |
| JP | 61-25768 | | 2/1986 |
| JP | 62-145830 | | 6/1987 |
| JP | 2-243263 | | 9/1990 |
| JP | 6-039705 | | 2/1994 |
| JP | 6-198561 | | 7/1994 |
| JP | 10-034530 | | 2/1998 |
| JP | 11-221756 | | 8/1999 |
| JP | 11-291162 | | 10/1999 |
| JP | 2000-094312 | | 4/2000 |
| JP | 2000-135667 | | 5/2000 |
| JP | 2000-167762 | | 6/2000 |
| JP | 2000-225556 | | 8/2000 |
| JP | 2000-334657 | | 12/2000 |
| JP | 2001-135602 | | 5/2001 |
| WO | 99/62672 | | 12/1999 |

OTHER PUBLICATIONS

"Advanced Engineering Plastics for the Semiconductor Industry", DSM Engineering Plastic Products (Polymer Corporation) product information bulletin, © 1996.

"Advanced Engineering Plastics for the Semiconductor Industry", DSM Engineering Plastic Products (Polymer Corporation) product information bulletin, © 1997.

Sanford, "High-Performance Resins Take Charge and More", *Machine Design*, pp. 52-56, 1996.

Examination Report dated Dec. 9, 2008 (and English translation therof) from Japanese Application No. 2003-111877, 4 pages.

* cited by examiner

VIBRATION DAMPING DURING CHEMICAL MECHANICAL POLISHING

CROSS-REFERENCE TO RELATED APPLICATIONS

This application: (1) is a continuation-in-part application of and claims priority to U.S. application Ser. No. 10/124,066, filed Apr. 16, 2002, now issued as U.S. Pat. No. 6,848,980, which is a continuation-in-part application of and claims priority to pending U.S. application Ser. No. 09/975,196, filed on Oct. 10, 2001; (2) is a continuation-in-part application of and claims priority to U.S. application Ser. No. 10/754,997, filed on Jan. 10, 2004, now issued as U.S. Pat. No. 7,014,545, which is a divisional application of U.S. application Ser. No. 09/658,417, filed Sep. 8, 2000, now issued as U.S. Pat. No. 6,676,497; and (3) is a continuation-in-part application of and claims priority to pending U.S. application Ser. No. 09/975,196, filed on Oct. 10, 2001, which is a continuation-in-part of U.S. application Ser. No. 09/658,417, filed Sep. 8, 2000, now issued as U.S. Pat. No. 6,676,497. The application herein claims the benefit of priority of all of the above listed patent applications and hereby incorporates by reference in their entirety the said patent applications.

TECHNICAL FIELD

This invention relates generally to chemical mechanical polishing systems and processes.

BACKGROUND

Integrated circuits are typically formed on substrates, particularly silicon wafers, by the sequential deposition of conductive, semiconductive or insulative layers. After a layer is deposited, a photoresist coating is applied on top of the layer. A photolithographic apparatus, which operates by focusing a light image on the coating, is used to remove predetermined portions of the coating, leaving the photoresist coating on areas where circuitry features are to be formed. The substrate is then etched to remove the uncoated portions of the layer, leaving the desired circuitry features.

As a series of layers are sequentially deposited and etched, the outer or uppermost surface of the substrate, becomes increasingly non-planar. This non-planar surface presents problems in the photolithographic steps of the integrated circuit fabrication process. Specifically, the photolithographic apparatus may not be able to focus the light image on the photoresist layer if the maximum height difference between the peaks and valleys of the non-planar surface exceeds the depth of focus of the apparatus. Therefore, there is a need to periodically planarize the substrate surface.

Chemical mechanical polishing (CMP) is one accepted method of planarization. Chemical mechanical polishing typically requires mechanically abrading the substrate in a slurry that contains a chemically reactive agent. During polishing, the substrate is typically held against a rotating polishing pad by a carrier head. The carrier head may also rotate and move the substrate relative to the polishing pad. As a result of the motion between the carrier head and the polishing pad, abrasives, which may either be embedded in the polishing pad or contained in the polishing slurry, planarize the non-planar substrate surface by abrading the surface.

The polishing process generates vibrations that may reduce the quality of the planarization or damage the polishing apparatus.

SUMMARY

In general, in one aspect, the invention features a carrier head for chemical mechanical polishing. The carrier head includes a backing assembly, a housing and a damping material. The backing assembly includes a substrate support surface. The housing is connectable to a drive shaft to rotate with the drive shaft about a rotation axis. The damping material is in a load path between the backing assembly and the housing to reduce transmission of vibrations from the backing assembly to the housing.

Implementations can include one or more of the following features. The carrier head can further include a gimbal mechanism between the backing assembly and the housing that permits at least a portion of the backing assembly to gimbal relative to the housing. The gimbal mechanism can include a top coupled to the housing, and a bottom coupled to the backing assembly, where the damping material is between the top and the bottom of the gimbal mechanism. In another implementation, the gimbal mechanism can include a substantially planar flexure ring that flexes in a direction perpendicular to the plane of the flexure ring to gimbal at least a portion of the backing assembly relative to the housing. The damping material is mounted to the flexure ring. The flexure ring can include a plurality of projections that extend into the damping material. Alternatively, the flexure ring can include a flange that extends into the damping material.

In one implementation, the damping material does not rebound to its original shape after being subjected to a deformation. For example, the damping material can rebound by less than approximately six percent of the deformation. The damping material can be viscoelastic. The backing assembly can include a flexible membrane secured to a substantially rigid base to define a pressurizable chamber and to provide the substrate support surface.

The invention can feature one or more of the following advantages. The transmission of vibrations from a backing assembly to a housing during a polishing operation can be reduced by a damping material. The damping material can be within a load path between the backing assembly and the housing.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
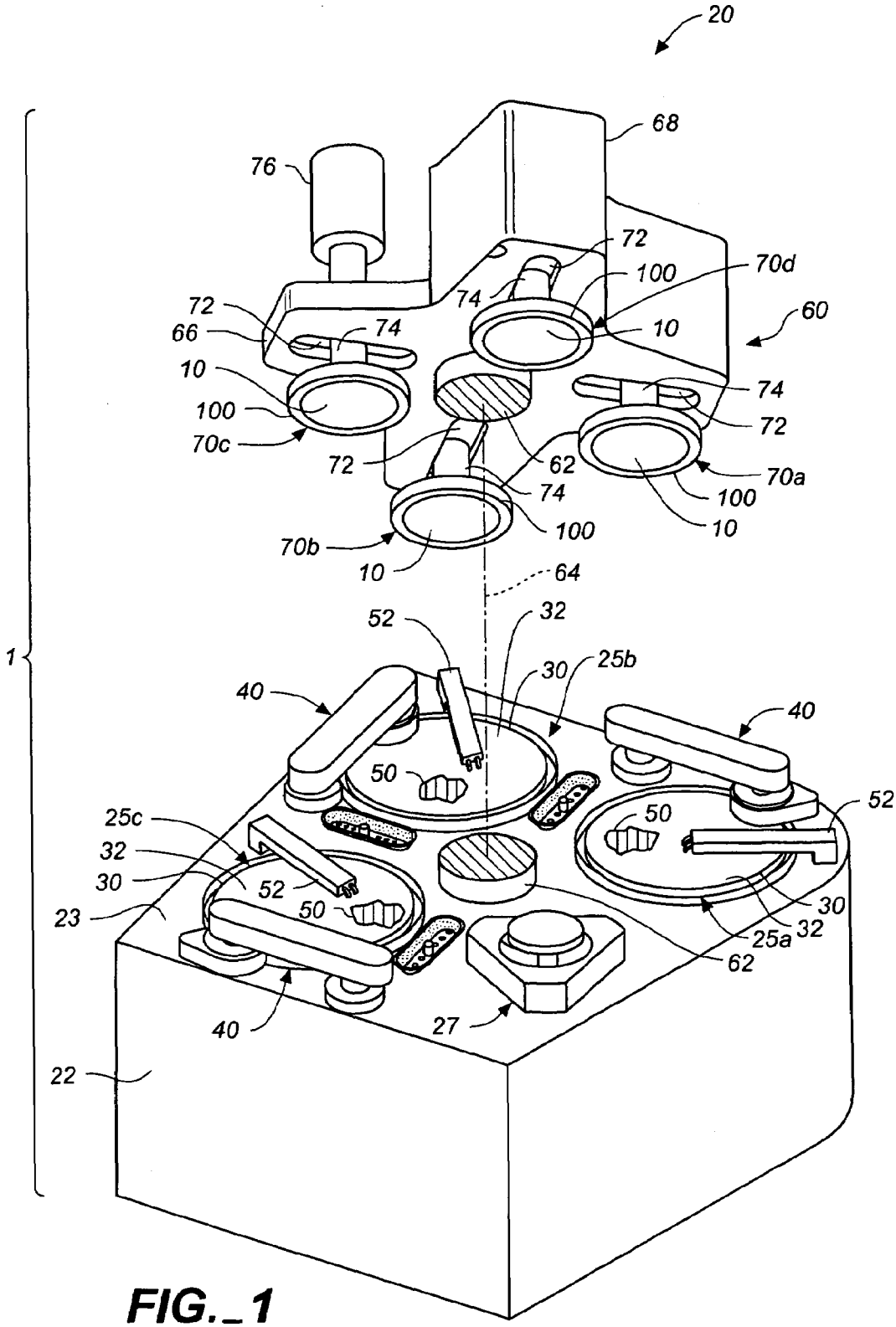
FIG. 1 shows a polishing machine having three polishing stations and four carrier heads.

FIG. 1 shows a chemical mechanical polishing (CMP) apparatus 1 for polishing a substrate 10. A description of a similar CMP apparatus may be found in U.S. Pat. No. 5,738,574, the entire disclosure of which is hereby incorporated by reference.

The CMP apparatus 1 includes a lower machine base 22 and a multi-head carousel 60. The lower machine base 22 has three polishing stations 25*a*, 25*b*, and 25*c* on a tabletop 23. Each polishing station 25*a*-25*c* includes a circular polishing pad 32, which is secured to a circular platen 30 of about the same diameter as the polishing pad 32, e.g., using a pressure sensitive adhesive (PSA). Platen 30 is driven by a platen drive motor located inside machine base 22. The polishing pad 32 can be a fixed-abrasive polishing pad, manufactured by 3M Superabrasives and Microfinishing Systems Division, or a standard polyurethane pad, such as IC-1010, manufactured by Rodel, Inc. Assuming the apparatus 1 is used for polishing "eight-inch" or "twelve-inch" substrates, the diameter of the polishing pad 32 and the platen 30 is between twenty and thirty inches.

A slurry arm 52 provides an abrasive or non-abrasive slurry to the polishing pad 32 through several spray nozzles (not shown). The slurry contains a reactive agent and a chemically reactive catalyzer. To polish an oxide substrate, deionized water is used as the reactive agent and potassium hydroxide is used as the catalyzer. The slurry arm 52 also provides fluid for rinsing the substrate.

The carousel 60 is positioned above the lower machine base 22. Carousel 60 includes four carrier head systems 70*a*-70*d* that are spaced at equal angular intervals about an axis 64 of symmetry of the carousel. Each carrier head system 70*a*-70*d* has a circular carrier head 100 for holding a substrate 10. The carrier head 100 is mounted on a drive shaft 74, which extends through a slot 72 to connect the carrier head to a carrier head rotation motor 76. The carrier head rotation motor 76 is supported on a slider (not shown).

During polishing, a pneumatic system (described below) lowers the carrier head 100 onto a polishing pad 32 to press the substrate 10 against the polishing pad 32 with a predetermined loading force. The platen drive motor rotates the platen, thereby causing the polishing pad 32 to rotate. At the same time, the rotation motor 76 rotates the substrate 10 by rotating the carrier head 100, while the slider (not shown) linearly drives the rotation motor 76 back and forth along the slot 72 to oscillate the carrier head 100 and the substrate 10 laterally on the surface of the polishing pad. Thus the apparatus moves the substrate 10 relative to the polishing pad 32, thereby abrading the surface of the substrate against abrasives contained within the polishing pad. The slurry arm 52 provides slurry 50, which contains a reactive agent (as previously described), to facilitate the polishing of the substrate. The loading and motion of the carrier head against the polishing pad, and the rotation speed of the polishing pad are carefully controlled to maintain a desired rate and quality of polishing.

One problem that can occur during chemical mechanical polishing is excessive vibration of the one or more structures in the polishing apparatus. For example, in some metal polishing processes, particularly in some copper polishing processes, friction between the substrate and the polishing pad causes vibration in the carrier head. This vibration can be transmitted through the drive shaft to other parts of the polishing apparatus, such as the carousel. In general, the vibration is dissipated as noise or shaking in the polishing apparatus.

Several implementations of the polishing apparatus 10 according to the invention are described herein. The implementations use a vibration damping material at different locations to significantly reduce the transfer of vibrational energy from one part of the polishing apparatus adjacent to the damping material to another adjacent part of the polishing system and thereby reducing or preventing vibration during polishing. Generally, the damping material has significantly better vibration damping characteristics than both adjacent parts of the polishing apparatus, which are typically made from stiff materials, e.g., metals. The damping material can be a visco-elastomer with little or no memory so as to provide good vibration damping characteristics.

In general, the damping material can be a material that absorbs vibrational energy and dissipates it as heat. The damping material can be a soft polymeric material, such as a polyvinylchloride (PVC). A suitable damping material is Isodamp C-1002, which is manufactured by EAR Specialty Composites of 7911 Zionesville Road, Indianapolis, Ind. 46268. Alternatively, the damping material can be a hard polymer, such as a mixture of polyphenylenesulfide (PPS), carbon fibers and polytetrafluoroethylene (PTFE, e.g., Teflon®, available from E.I. Dupont), e.g., with 55%/35%/10% by weight.

Figure 2:
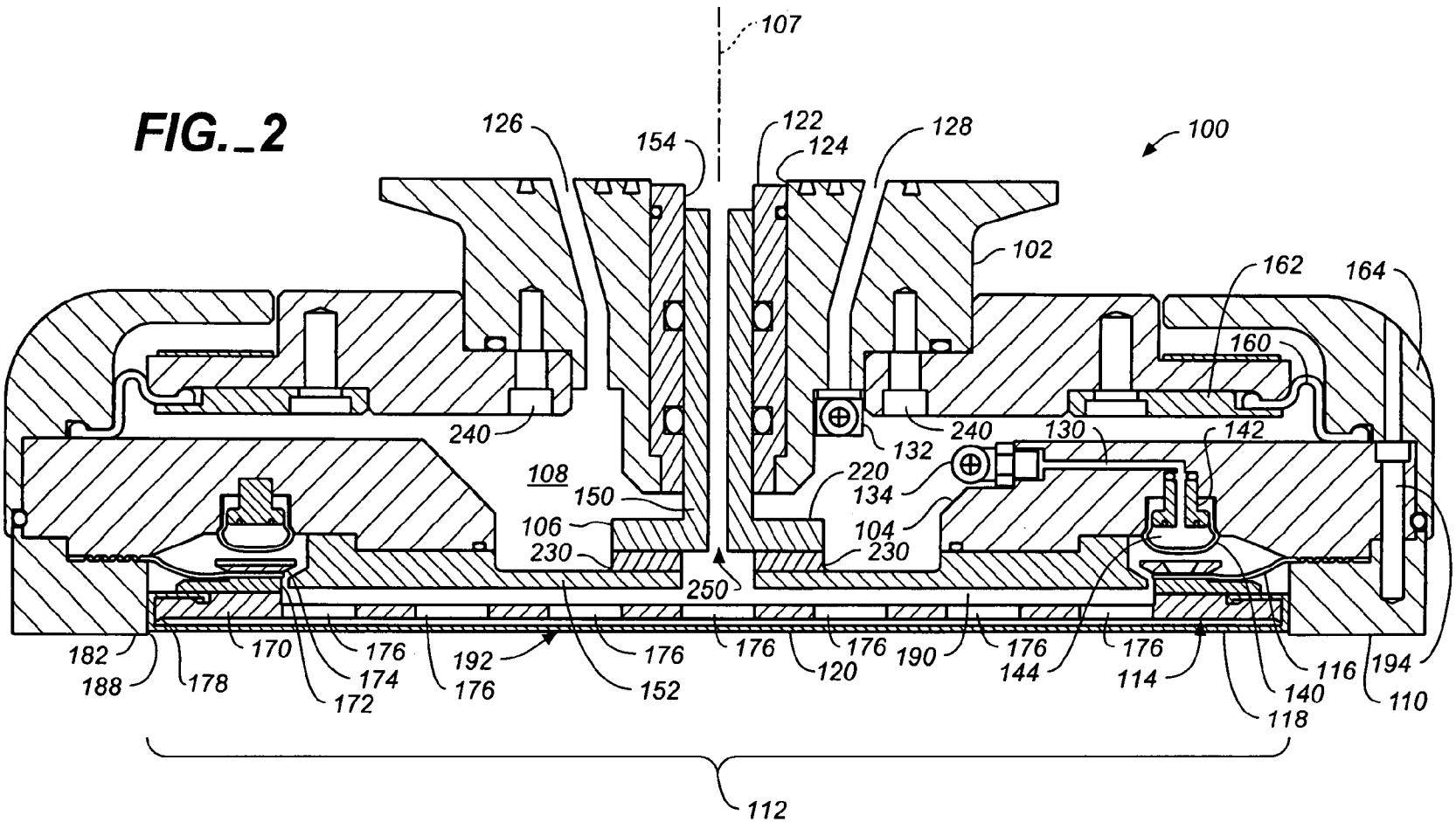
FIG. 2 is a cross-sectional view of a carrier head of FIG. 1, which includes a retaining ring.

Referring to FIG. 2, a first implementation that has the vibration damping material in the carrier head 100 will be described. Carrier head 100 typically includes a housing 102, a base 104, a gimbal mechanism 106, a retaining ring 110, and a substrate backing assembly 112. The housing 102 is substantially cylindrical and can be connected to a drive shaft 74 to rotate about an axis 107. A passage 126 extends through the housing for pneumatic control of the carrier head, as will be described below. The housing 102 can have a cylindrical bushing 122 fitted into a vertical bore 124 which runs vertically through the housing.

Gimbal mechanism 106 has a gimbal rod 150, which is fitted into the bushing 122 so that the rod 150 is free to move vertically within the bore. The bushing 122 prevents lateral motion of the gimbal rod 150. A gimbal ring 220 is attached to the gimbal rod 150. A flexure ring 152 is attached to the gimbal ring 220 through a damping material 230, to prevent or reduce the transmission of vibration energy from the flexure ring 152 to the housing 102, through the gimbal ring 220. The damping material 230 can be about 0.06 inches thick. Pressure sensitive adhesive (not shown) adheres the damping material 230 to both the housing 102 and the flexure ring 152.

The flexure ring 152, which is a generally planar annular ring, is attached to the generally ring-shaped base 104. The flexure ring 152 flexes in a direction perpendicular to the plane of the flexure ring 152, thereby gimballing the base 104 to the gimbal rod 150 and the housing 102. The gimbal mechanism also allows the base 104 to move up and down by allowing the gimbal rod 150 to move vertically within the bore 122, while preventing any lateral motion of the base. The damping material 230 reduces or prevents the transmission of vibrational energy from the base 104 into the housing 102 through the gimbal mechanism 106.

An outer clamp ring 164 clamps a rolling diaphragm 160 to the base 104, and an inner clamp ring 162 clamps the rolling diaphragm 160 onto the housing 102. Thus, the rolling diaphragm 160 seals the loading chamber 108 formed by the housing 102, the gimbal rod 106, the gimbal ring 220, the damping material 230, the flexure ring 152, and the base 104, leaving an opening 126 into the chamber 108. The opening 126 is connected to a pump (not shown), which lowers or raises the base by pumping fluid, e.g., air, into or out of the chamber 108, respectively. By controlling the pressure of the fluid pumped into the loading chamber 108, the pump can press down the base towards the polishing surface with a desired loading force.

The retaining ring 110 is a generally annular ring bolted onto the base 104, e.g., by bolts 194 (only one is shown in the cross-sectional view of FIG. 2). During polishing, fluid is pumped into the loading chamber 108, thereby generating pressure in the chamber 108. The generated pressure exerts a downward force on the base 104, which in turn exerts a downward force on the retaining ring 110. The downward force presses the retaining ring 110 against the polishing pad 32.

The substrate backing assembly 112 includes a flexure diaphragm 116, which is clamped between the retaining ring 110 and the base 104. An inner edge of the flexure diaphragm 116 is clamped between an annular lower clamp 172 and an annular upper clamp 174 of a support structure 114, and an outer edge of the flexure diaphragm is clamped between the base 102 and the retaining ring 110. A support plate or support ring 170 of the support structure 114 is attached to the lower clamp 172. The flexure diaphragm allows some vertical motion of the support plate 170 relative to the base 104. The support plate 170 is a generally disk-shaped rigid member with a plurality of apertures 176 through it (only one is labeled in FIG. 2). The support plate 170 has a downwardly projecting lip 178 at its outer edge. A flexible membrane 118 extends around the lip 178 of the support plate 170 and is clamped between the support plate 170 and the lower clamp 172, to form a generally disk shaped lower surface 120. The flexible membrane is formed from a flexible and elastic material. Alternatively, the flexure diaphragm and the flexible membrane can be combined in a single-piece membrane.

The sealed volume between the flexible membrane 118, support structure 114, flexure diaphragm 116, base 104, and flexure ring 152 defines a chamber 190 with an opening 250 that runs through the gimbal rod 150. A pump (not shown) is connected to the opening 250 to control the pressure in the chamber 190 by pumping fluid, into the chamber through the opening 250, thereby controlling the downward pressure of the membrane lower surface 120 on the substrate 10.

An inner surface 188 of the retaining ring 110 in conjunction with the lower surface 120 of the flexible membrane 188 define a cavity 192 for receiving a substrate. The retaining ring keeps the substrate from slipping laterally out of the cavity 192, while the lower surface 120 of the flexible membrane 188 pushes the substrate, contained within the cavity 192, against the polishing pad 32 (FIG. 1).

Figure 3A:
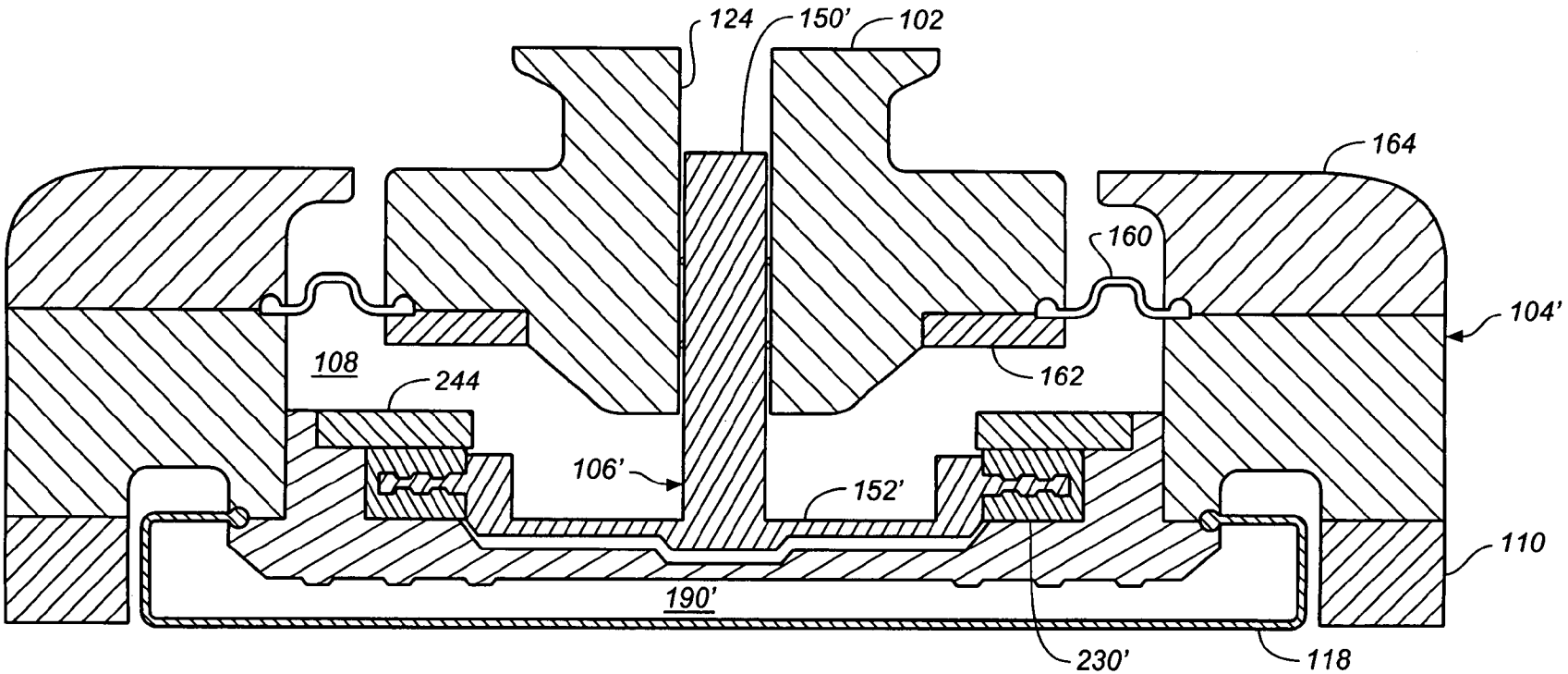
FIG. 3A is a cross-sectional view of an alternative implementation of a carrier head.
Figure 3B:
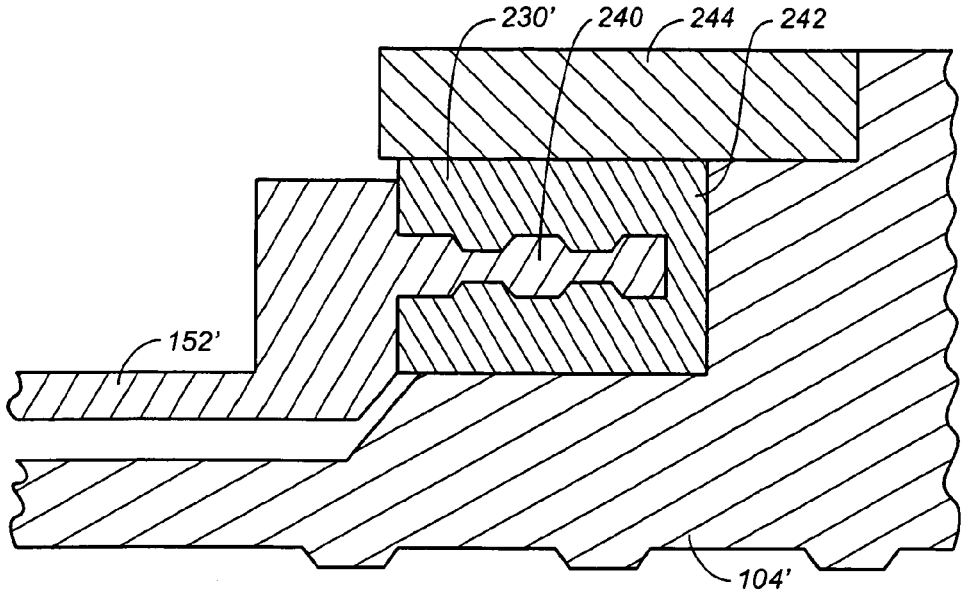
FIG. 3B is an expanded view of the damping material from the carrier head of FIG. 3A.

Referring to FIGS. 3A and 3B, in another implementation, the gimbal rod 150' and flexure ring 152' are formed as a unitary single part. In addition, this implementation does not include a support structure 114 or a flexure 116. Rather, the flexible membrane is connected directly to the base 104'.

In this implementation, the damping material 230' is placed between the flexure ring 152' and the base 104'. Specifically, the flexure ring 152' includes a plurality of knobbed projections 240 that extend radially outward into slots 242 in the base 104'. The slots 242 are filled with the viscoelastic damping material 230', and the top of the slot is closed with an annular ring 244 that is secured to the rest of the base 104'. For example, the damping material can include a lower layer between the projections 240 and the base, thus less vibrational energy is transmitted from the base 104' to the gimbal 106'.

Figure 3C:
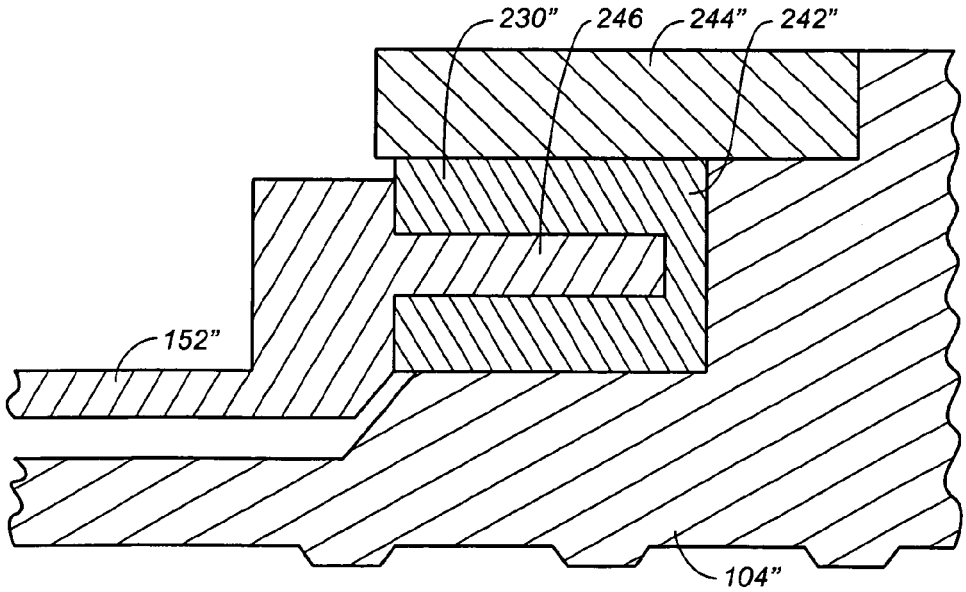
FIG. 3C is an alternative expanded view of the damping material from the carrier head of FIG. 3A.

Alternatively, as shown in FIG. 3C, rather than individual projections 240, the flexure ring 152" can include an annular flange 246 that extends radially outwardly and is trapped in the viscoelastic damping material 230" between the base 104" and the annular ring 244".

Figure 4:
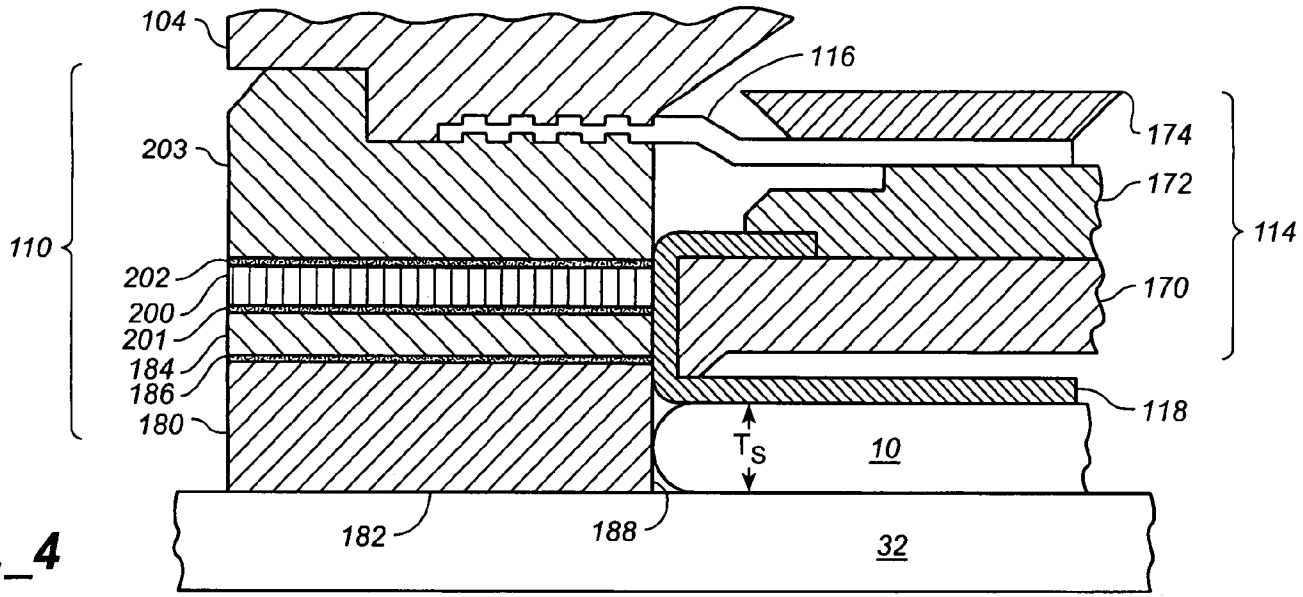
FIG. 4 is a more detailed cross-sectional view of the retaining ring of FIG. 2 during polishing.

Another implementation includes the damping material in the retaining ring itself. Referring to FIG. 4, the annular retaining ring 110 includes four portions, which are stacked one on top of another. An upper portion 203 and a middle portion 184 of the retaining ring 110 are rigid rings. For example, the upper portion 203 can be a stainless steel ring with a thickness of about 0.1 inches, and the middle portion 184 can be a stainless steel ring with a thickness of about 0.25 inches. The upper portion 203 is attached to the middle portion 184 through a damping material 200, which is similar in thickness and is made from the same material as the damping material 230 of FIG. 2. The damping material 200 reduces or prevents the transmission of vibration energy from the middle portion 184 to the upper portion 203. Pressure sensitive adhesive 202 adheres the damping material 200 to the upper portion 203, while pressure sensitive adhesive 201 adheres the damping material 200 to the middle portion 184.

The lower portion 180 is a relatively softer material that is chemically inert in the polishing process, such as polyphenylene sulfide (PPS), available from DSM Engineering Plastics of Evansville, Ind. The lower portion 180 can be durable but gradually wear away with use. The lower portion 180 has a bottom surface 182, which contacts the polishing pad 32 during polishing. The bottom surface can have substantially radial grooves (not shown) for transporting slurry from the outside of the retaining ring to the surface of the substrate 10. The middle portion 184 can add rigidity to the lower portion 180, thereby reducing the deformation of the retaining ring during polishing. The middle portion 184 can be secured to the lower portion 180 by a layer of epoxy adhesive 186, such as Magnobond-6375TM, available from Magnolia Plastics of Chamblee, Ga.

The thickness of the lower portion 180 should be larger than the thickness TS of the substrate 10. Specifically, the lower portion 180 should be thick enough that the substrate 10 does not contact the adhesive layer 186. On the other hand, if the lower portion 180 is too thick, the bottom surface 182 of the retaining ring 110 may be subject to deformation due to the flexible nature of the lower portion 180. The initial thickness of the lower portion is typically between 200 to 400 mils. The lower portion 180 is replaced when the remaining thickness of the retaining ring is about the same as the thickness of the substrate.

Figure 5:
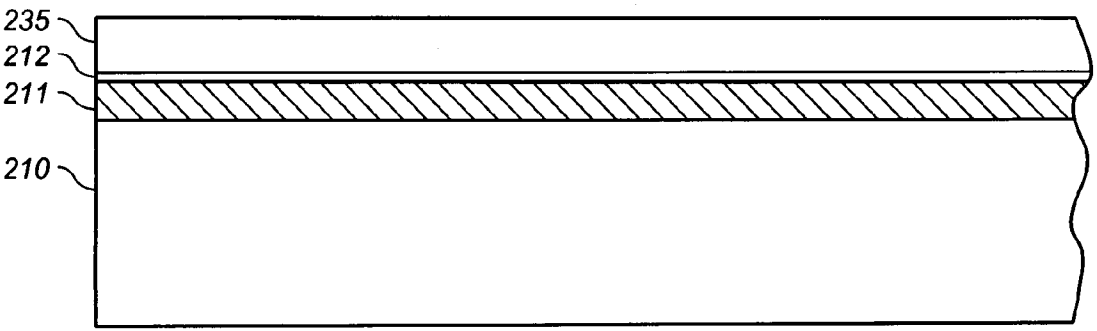
FIG. 5 is a cross-sectional view of a portion of a polishing station.

Referring to FIG. 5, another implementation has a damping material 211 located between the polishing pad 240 and the platen 210 to reduce or prevent the transmission of vibration energy from the polishing pad 240 to the platen 210. The damping material 211 is similar in thickness and is made from the same material as the damping material 230 of FIG. 2. A pressure sensitive adhesive layer 213 adheres the damping material 211 to the polishing platen 210.

The damping material 211 is attached to the polishing pad 240 through a protective layer 215. The protective layer 215 is a 0.01-inch thick Teflon sheet that makes it easier to detach the polishing pad 240 from the damping material 211. A layer of pressure sensitive adhesive 212 adheres the protective layer 215 to the damping material 213, while a second layer of pressure sensitive adhesive (not shown) adheres the protective layer 215 to the polishing pad 240.

Figure 6:
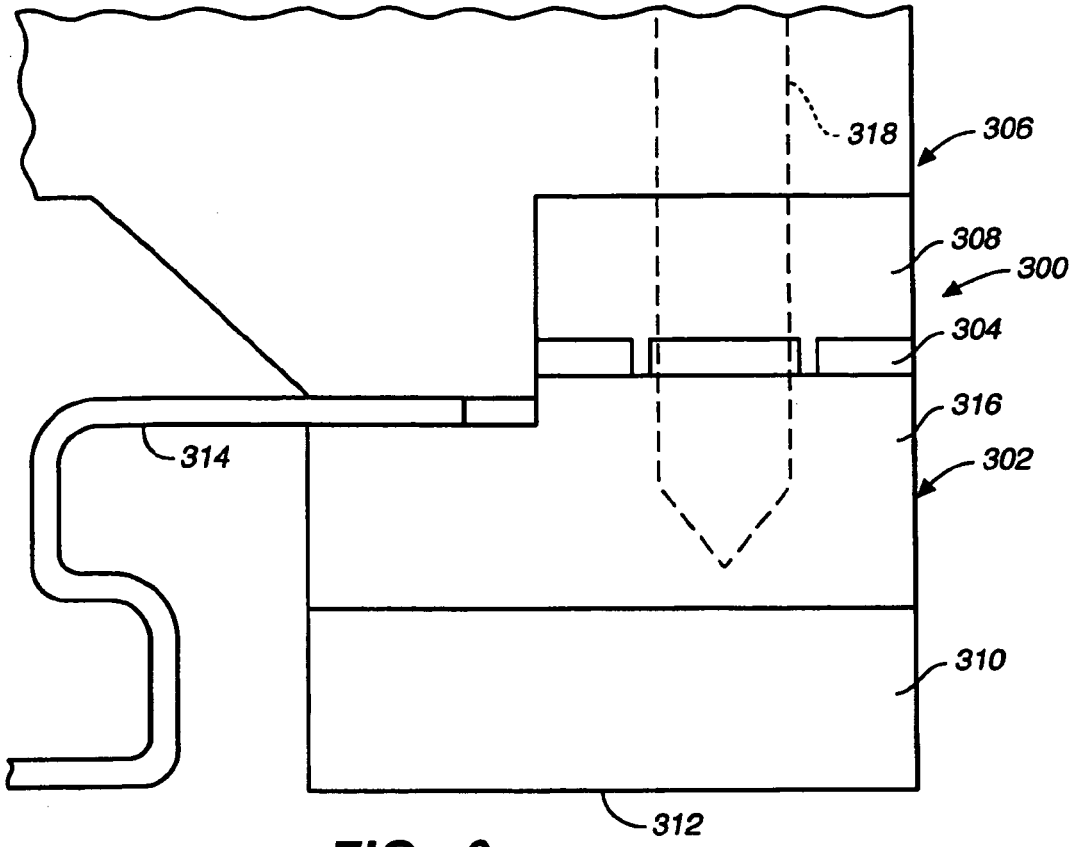
FIG. 6 is a cross-sectional view of another implementation of a carrier head.

Referring to FIG. 6, in yet another implementation the retaining ring 302 includes an annular upper portion 316 that is more rigid than the lower portion 310. For example, the upper portion 316 of the retaining ring 302 can be stainless steel and the lower portion 310 of the retaining ring 302 can be PPS. Optionally, a more rigid sleeve may be inserted into the inner diameter of the retaining ring to reduce wear caused by the substrate. Optionally, the entire retaining ring 302 may be formed of the same material.

A layer or gasket of a damping material 304 is positioned between the retaining ring and the base 306 of the carrier head 300 to absorb and dissipate vibrational energy. The damping material can be a polyurethane foam or a polymeric material. Depending on the polishing conditions, a minimum thickness may be required for the gasket 304. The damping material can be a polyvinylchoride thermoplastic, such as Isodamp C-1002, available from EAR Specialty. In this case, the damping material should be precompressed by about 5-15% in thickness.

In addition, a portion 308 of the base to which the retaining ring is attached is formed from a polymer material. For example, a ring-shaped insert 308 may be placed between the base 306 and the damping material 304. The retaining ring 302 can be secured to the base 306 by inserting screws or bolts through the holes 318 in the insert 308 and gasket 304 into the upper layer 316 of the retaining ring. The ring-shaped insert 308 can have bosses around each screw. The tops of the bosses can contact the top surface of the upper portion 316 of the retaining ring. The bosses can control the amount of compression of the damping material and can secure the screws to ensure a tight connection between the base 306 and the retaining ring 300. The polymer material can be a mixture of polyphenylenesulfide (PPS), carbon fibers and polytetrafluoroethylene, e.g., 50-55%, 30-35%, 10-15% by weight, respectively.

Alternatively, the entire base 306 can be formed of a polymer material. In addition, the retaining ring 302 could be secured to the base 306 by an adhesive, such as an epoxy, by a clamp, or by some other mechanism.

An edge of a flexible membrane 314 can be clamped directly between the upper surface of the retaining ring 302 and the base 306 as illustrated in FIG. 6. Alternatively the flexible membrane can be clamped between the damping material 304 and the base 306, or the flexible membrane 314 can be clamped between the retaining ring 302 and the damping material 304, or the flexible membrane could be attached in another fashion to the retaining ring, the base, or to another section of the carrier head.

Separately or in combination with one or more of the above implementations, it may also be possible to reduce vibrations by proper selection of the materials in the lower portion of the retaining ring. Possible materials for the lower portion include polytetrafluoroethylene (PTFE, e.g., Teflon®, available from E.I. Dupont), perfluoroalkoxy PTFE (PFA), polyethylene terephthalate (PET), polyetheretherketone (PEEK, e.g., Arlon®-1000, available from Green, Tweed & Co.), polyetherketoneketone (PEKK), polybenzimidazole (PBA, e.g., Celazole®, available from Celanese AG), an imidized thermoset polyimide (such as Duratron® XP, available from DSM Engineering Plastics Products, Inc.), a semi-crystalline thermoplastic polyester (such as Ertalyte®, available from DSM Engineering Plastics), a long molecular chain molecule produced from poly-paraphenylene terephthalamide (such as Kelvar®, available from E.I. DuPont), or a blend of one or more of the above materials, possibly including other materials, such as graphite or carbon fibers. For example, the retaining ring can include Zymaxx® (a composite material available from E.I. DuPont with about 80% Teflon® and 20% carbon fibers), Zymaxx® 6400 (a composite material with about 80% Teflon® and 20% Kelvar®), bearing grade Ryton® (a composite material with about 75% PPS, 15% carbon fiber and 10% Teflon®, available from Chevron Phillips Chemical Company LP), Avalon®-69 (a composite material with about 80% Teflon®, 17% PPS and 3% graphite, available from Green, Tweed & Co), Arlon®-1286 (a composite material with about 60% PEEK and 40% carbon fiber), Arlon®-1330 (a composite material with about 85% PEEK and 15% Teflon®), Arlon®-1555 (a composite material with about 70% PEEK, 10% Teflon®, 10% carbon fibers and 10% graphite), and Ertalyte® TX (a composite material with Ertalyte® and Teflon®).

The lower portion should be chosen to be chemically inert in the polishing process. The lower portion should be sufficiently pliant that the force of the substrate edge against the inner surface of the retaining ring does not chip or otherwise damage the substrate, without excessive wear or particle generation. The specific optimal material may depend on other polishing parameters, such as slurry composition, platen and head rotation rates and applied pressure to the retaining ring and substrate.

For a working example, a carrier head according to FIG. 6 was constructed using a gasket 308 composed of Isodamp C-1002 having a thickness of 60 mils, a ring-shaped insert 308 about 280 mils thick (including bosses which were about 56 mils tall) composed of a composite material with about 50-55% PPS, 30-35% carbon fiber, and 10-15% Teflon®, a stainless steel upper portion 316, and a PPS lower portion 310. The construction demonstrated reduced noise during copper polishing, using an applied pressure of 6 psi on the polishing pad from the substrate membrane, an applied pressure of 2.2 to 5.8 psi on the polishing pad from the retaining ring, and simultaneous conditioning.

A number of embodiments of the invention have been described. Nevertheless, it will be understood that various modifications may be made without departing from the spirit and scope of the invention. For example, the damping material may be used with other kinds of polishing apparatus known to persons skilled in the art. For instance, the retaining ring in the apparatus need not contact the polishing pad, as described in the specification. One of the polishing pad and the retaining ring of the polishing system may not rotate at all. The damping material may be used in a polishing apparatus that uses an abrasive or a non-abrasive polishing pad, and the polishing liquid provided to the polishing pad can be a slurry that contains abrasives, such as silicon dioxide particles, in a chemically reactive agent, such as deionized water or potassium hydroxide, or an abrasiveless liquid.

The vibration damping material may also be used in any pair of the locations described in the specification, or even in all of the locations described. Other materials with suitable damping properties may be used to damp vibrations, so long as they significantly reduce or prevent the transmission of vibrational energy from one end of the material to another. Any material that does not rebound to its original shape when deformed may be used as a damping material. Specifically, when subjected to a deformation, the damping material should rebound by less then ten percent of the deformation, although a rebound of less than six percent of the deformation is preferred. For instance, the damping material may be any isodamp C-1000 series isolation damping material, manufactured by EAR Specialty Composites, a visco-elastomer, a soft-plastic, or any other material that has better vibration damping properties than materials immediately adjacent to the damping material.

The thickness of the damping material may be varied to provide optimum results in operating conditions that have different loading, carrier head rotation speed, polishing pad rotation speed, damping material, and so on. A thicker damping material may be used to improve the vibration damping, although poor control of the relative motion of the substrate and the polishing pad may result from a damping material that is too thick. A thinner damping material may also be used, although if the damping material is too thin, it may not sufficiently reduce or prevent the transmission of vibrational energy.

The middle portion 184 and the upper portion 203 (FIG. 4) of the retaining ring maybe manufactured from aluminum or any other material that provides a suitable amount of stiffness to the retaining ring. The thickness of the middle portion 184 and the upper portion 203 may be varied, although if the middle and upper portions are too thin, the retaining ring may deform and reduce the quality of polishing. Alternatively, the middle portion 184 and the lower portion 180 (FIG. 4) of the retaining ring 110 may be one integrated piece formed from the same kind of material, e.g., PPS or stainless steel. Other adhesive or attachment methods known to persons of skill may be used to affix the damping material.

Accordingly, other embodiments are within the scope of the following claims.

What is claimed is:

1. A carrier head for chemical mechanical polishing, comprising:

a backing assembly including a substrate support surface;

a housing connectable to a drive shaft to rotate with the drive shaft about a rotation axis;

a damping material in a load path between the backing assembly and the housing to reduce transmission of vibrations from the backing assembly to the housing; and a gimbal mechanism between the backing assembly and the housing that permits at least a portion of the backing assembly to gimbal relative to the housing, where the gimbal mechanism includes;

a substantially planar flexure ring that flexes in a direction perpendicular to the plane of the flexure ring to gimbal at least a portion of the backing assembly relative to the housing; and the damping material is mounted to the flexure ring.

2. The carrier head of claim 1, where the flexure ring includes a plurality of projections that extend in to the damping material.

3. The carrier head of claim 1, where the flexure ring includes a flange that extends into the damping material.

* * * * *